United States Patent [19]

Brady et al.

[11] Patent Number: 4,787,776

[45] Date of Patent: Nov. 29, 1988

[54] METHOD OF DIRECTING OR HOLDING WATER

[75] Inventors: Sam A. Brady; Michael D. Meddaugh; Michael G. Elias; John D. Gavin, Jr., all of Midland, Mich.

[73] Assignee: Dow Corning Corporation, Midland, Mich.

[21] Appl. No.: 288,265

[22] Filed: Jul. 30, 1981

[51] Int. Cl.[4] ..... E02B 5/02

[52] U.S. Cl. ..... 405/270; 405/52; 405/128; 405/258; 428/266

[58] Field of Search ..... 405/270, 118, 258, 128, 405/129; 428/266, 268, 447; 528/18-23; 156/71, 94, 280

[56] References Cited

U.S. PATENT DOCUMENTS

| | | | |
|---|---|---|---|
| 2,170,671 | 8/1939 | Adler | 405/118 |
| 3,189,576 | 6/1965 | Sweet | 528/22 X |
| 3,294,725 | 12/1966 | Findlay et al. | 528/23 X |
| 3,334,067 | 8/1967 | Weyenberg | 528/17 |
| 3,474,625 | 10/1969 | Draper et al. | 405/270 |
| 3,485,661 | 12/1969 | Campbell et al. | 428/266 |
| 3,555,828 | 1/1971 | Goldstein et al. | 405/264 |
| 3,763,072 | 10/1973 | Krieger | 405/270 X |
| 3,949,113 | 4/1976 | Draper et al. | 405/270 X |
| 4,207,017 | 6/1980 | Jarrel | 405/270 |
| 4,221,688 | 9/1980 | Johnson et al. | 528/18 X |
| 4,230,061 | 10/1980 | Roberts et al. | 428/266 X |
| 4,293,440 | 10/1981 | Elphingstone et al. | 405/270 X |

OTHER PUBLICATIONS

"Proceedings of the Water Harvesting Symposium, Phoenix, Arizona, Mar. 26-28, 1974", Agricultural Research Service, USDA, GPO791-043; Michelson, pp. 93-102; McBride & Shiflet, pp. 115-121; Plueddemann, pp. 76-83; Dedrick, pp. 175-191.

*Primary Examiner*—Dennis L. Taylor

*Attorney, Agent, or Firm*—Edward C. Elliott

[57] ABSTRACT

A method of constructing a means suitable for directing or holding water is described. A depression suitable to direct, transport, or hold water, such as a water catchment or irrigation ditch is covered with cloth, any seams are fastened together, then the cloth is coated with a liquid silicone elastomeric composition curable at atmospheric conditions. The coated cloth edges are stabilized. The method yields a depression having a surface impervious to liquid water that has a long expected life due to its resistance to damaging effects such as weathering and exposure to wandering animals.

35 Claims, 4 Drawing Sheets

METHOD OF DIRECTING OR HOLDING WATER

BACKGROUND OF THE INVENTION

1. Field of the Invention

This invention relates to a method of on-site construction of a cloth reinforced silicone elastomeric coating upon the surface of a depression suitable to direct, transport or hold water. The coated surface prevents loss of water into the earth while directing the water to a predetermined destination or holding the water in place.

2. Description of the Prior Art

Water harvesting is a technique for developing local water supplies for such things as livestock, wildlife, runoff farming, and domestic use. Ancient desert farmers cleared hillsides and smoothed the soil to increase the amount of rain water that flowed down the hill. Contour ditches carried the runoff to lower lying fields where the water was used to irrigate crops.

In more recent history, the collection of rainwater from the roofs of homes and its storage in a cistern was common practice until the widespread development of central water systems in cities.

Systems have been evaluated for collecting water supplies for livestock in semiarid rangeland. Mikelson has reported on the use of metal sheeting, butyl rubber sheeting, asphalt roofing, and soil-bentonite mixtures as methods of collecting water for transportation to storage areas. Mikelson's report in "Proceedings of the Water Harvesting Symposium, Phoenix, Ariz., Mar. 26–28, 1974," published by the Agricultural Research Service, U.S. Department of Agriculture, indexed as GPO791-043, pages 93 to 102, concludes that water harvesting catchments tested can be useful, but the costs are high. The effects of weathering reduces the useful life of all methods. High winds and sunlight tend to destroy the covering materials. McBride and Shiflet report in the same reference, pages 115 to 121, on water harvesting catchments of various types, including glass fiber-asphalt constructions. Those glass fiber-asphalt constructions coated the soil, after sterilization, with glass fiber mat which was then coated with cationic liquid asphalt emulsion and overcoated with roofing type clay asphalt emulsion. The emulsion requires replacement at 3 to 5 year intervals. The surface was often broken by plants, burrowing rodents and ants. Dedrick reports in the same reference on storage systems at pages 175 to 191. In addition to methods mentioned above, he discusses the use of plastic film, ethylene-propylene rubber and chlorosulfonated polyethylene sheeting, and hard surface linings such as portland cement concrete. The rubber coatings must be protected from mechanical damage and weathering. The hard surface linings are expensive to install and subject to damage from alternating freezing and thawing.

In the same reference, at pages 76 to 83, Plueddemann reports on testing under laboratory conditions a variety of latex polymers and water repellants for suitability for treatment of soil to improve water harvesting. His recommendation is a mixture of an SBR latex mixed with an emulsion of silicone fluid. Experiments are given to show usefulness, but all work was in a laboratory as experiments. In his conclusion he states that the silicone emulsion alone is completely ineffective, but is a very effective water repellent when mixed with a suitable polymer latex.

A companion technique for the development of local water supplies is the use of canals or ducts to transport water from an available source to the desired predetermined location. The source, of course, must be located high enough above the predetermined location so that the water will flow with sufficient velocity to deliver the required amounts. Canals, aqueduct, and irrigation ditches have varied in construction from earthen ditches to concrete lined ditches and masonry aqueducts. Lining ditches with concrete is difficult and expensive, so it has been primarily confined to large canals. In small ditches or ducts as used in irrigation systems, the cost of concrete linings is prohibitive.

An earthen ditch such as used in irrigation systems can waste a majority of the water that enters the system. Water soaks into the walls and bottom of the ditch all along its length. Wet soil along the ditch readily grows vegetation which further uses additional water through transpiration. Vegetation growing under the water surface further retards the flow of water through the ditch, exposing the water to further losses through evaporation. Water lost during transporting from source to the use location is wasted. In arid locations such waste may be of great importance due to the lack of sufficient water at the source to make up for the loss in transporting.

SUMMARY OF THE INVENTION

An economical method suitable for directing or holding water is described. The method yields a water impervious covering upon an appropriate earth surface, such as a catchment or irrigation ditch, that is easily constructed in place. The method comprises laying cloth on an earth surface of a depression suitable to direct, transport or hold water, fastening the cloth together at seams, coating the cloth with a liquid silicone elastomeric composition curable at atmospheric conditions, allowing the coating to cure, and stabilizing the cloth edges. The seams are preferably bonded together by applying a liquid silicone elastomeric composition which is curable at atmospheric conditions. The liquid silicone elastomeric composition is preferably an aqueous silicone emulsion.

It is an object of this invention to provide a method of constructing a water harvesting structure or its components that is economical to manufacture, yet has a long service life, by lining the structure with a cloth and coating the cloth with a liquid silicone elastomeric composition to yield a reinforced silicone elastomeric membrane impervious to liquid water that is constructed in place.

It is an object of this invention to provide a covering suitable for directing or holding water that is manufactured in place upon an appropriate earth surface.

BRIEF DESCRIPTION OF THE DRAWINGS

Referring to the drawings.

DESCRIPTION OF THE INVENTION

This invention relates to a method of constructing a means suitable for directing or holding water comprising (A) laying cloth on an earth surface of a depression suitable to direct, transport or hold water, (B) fastening the cloth at seams, then (C) coating the cloth with liquid silicone elastomeric composition curable at atmospheric conditions, (D) allowing the composition to cure at atmospheric conditions to yield a covering impervious to liquid water, and (E) stabilizing the cloth at unseamed edges.

Following the method of this invention yields a covering, in contact with an appropriate earth surface, that has been constructed in place.

The means for directing or holding water comprises a depression lined with a cloth that follows the contour of the depression. The cloth, which can consist of many pieces, is fastened together at adjoining edges to make seams. The cloth is then coated with a liquid silicone elastomeric composition curable at atmospheric conditions. The coated cloth is allowed to dry and the unseamed edges at the perimeter of the cloth are stabilized to prevent movement of the coated cloth.

The method of this invention concerns means for economically collecting, transporting, and holding water by moving water by means of gravity flow over or through lined depressions, such as catchments, transporting ducts, and holding ponds. The method is adaptable to construction using common tools and unskilled labor so that the method is economical. The method is adaptable to both large and small constructions in areas that are easily accessable or in remote locations that are difficult to reach, such as isolated mountainous regions.

Figure 1:
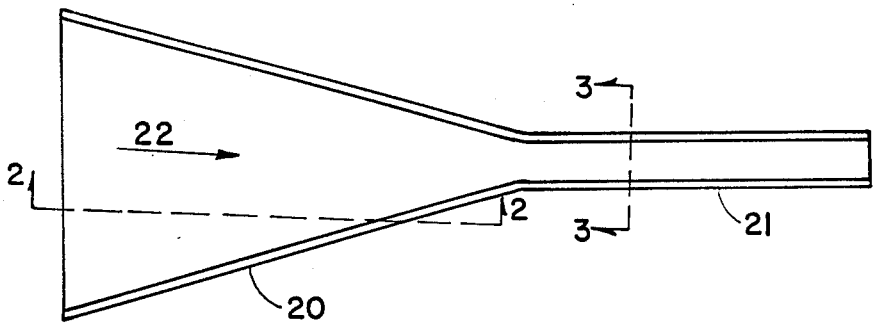
FIG. 1 is a top view of a catchment 20 and transporting duct 21.

To further explain the invention, a construction comprising a catchment 20 and transporting duct 21 will be discussed as illustrated in FIG. 1 as examples of a depression suitable to direct and transport water. The direction of water flow is shown as 22.

The area of the catchment is determined by the area of suitable land available, as well as the area necessary in order to collect the required amount of water. The more water required, the larger the area required. The lower the amount of expected precipitation, the larger the area required. The area should have a gradual slope so that the water flows down the catchment area and through the transporting duct to the predetermined destination. The predetermined destination can be a storage tank or pond to store the water, or it can be an irrigation system to distribute the water to crops.

Figure 2:
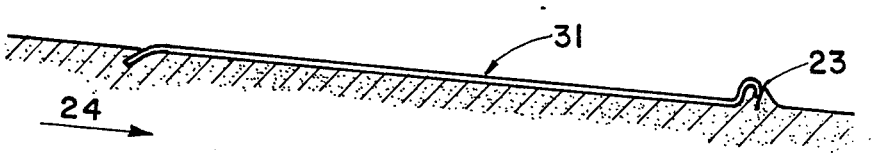
FIG. 2 is a cross section of a catchment 20 along line 2—2 in FIG. 1.

FIG. 2 is a cross section of the catchment 20 along line 2—2 in FIG. 1. The direction of slope is shown by 24. A dike 23 is built up of earth to aid in directing the water flow to the transporting duct. The dike is built up to a height sufficient to contain the maximum amount of water expected to be present at any one time. In snowfall areas, the dike will also tend to trap snow which could otherwise blow away before melting. The coated cloth 31 is present, in areas of porous soil, to prevent the water collected by the catchment from soaking into the earth, rather than flowing down to and through the transporting duct. The coated cloth also aids in preventing the destruction of the catchment and transporting duct due to long term weathering.

In an area that consists primarily of impervious soil or rock, the suitable catchment can consist essentially of a dike or dikes arranged at the lower end of the catchment area to direct water flowing down over the surface of the catchment area to the transporting duct.

The upper edge of the coated cloth is shown buried in the soil to stabilize it. Water flowing down the slope flows over the buried cloth edge onto the coated cloth surface and is directed by the dikes into the transporting duct. The coated cloth lining the catchment area, dikes, and transporting duct prevents loss of water by soaking into the ground and also prevents erosion of the catchment and transporting duct due to the flowing water.

Figure 3:
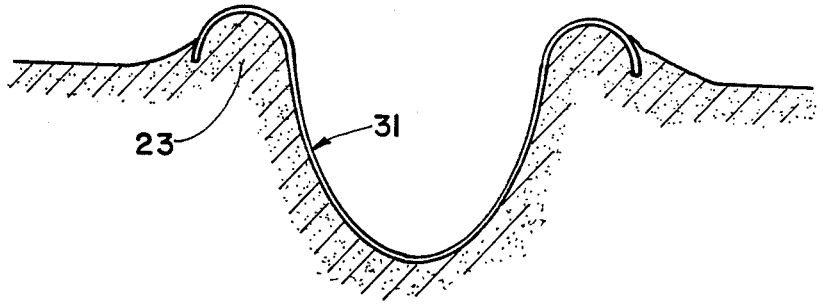
FIG. 3 is a cross section of transporting duct 21 along line 3—3 in FIG. 1.

FIG. 3 is a cross section of a transporting duct 21 along line 3—3 in FIG. 1. The duct is constructed of such a size that it is capable of containing the flow of water from the catchment or other source. The dike 23 on the edge of the duct prevents surface water from flowing under the coated cloth which lines the surface of the duct. The coated cloth is used here for the same purposes as in the catchment.

The depression used in the method of this invention must be shaped to direct or contain the water as desired. A depression intended to transport water must, of course, slope in the direction of desired water flow. The amount of slope is chosen to assure water flow without excessive speed. It is desirable to clear the area of all vegetation and smooth the surface left by clearing to as great an extent as practical. A smooth surface such as that left by raked sand or soil makes possible a smooth coated cloth that maximizes water flow and minimizes hold up of water. A smooth surface under the cloth also makes it easier to lay out the cloth and fasten pieces together at seams.

If the earth surface of the depression is such that the growth of plants or seeds in the surface is likely, it is desirable to treat the surface with a herbicide to prevent possible growth under the coated cloth after it is in place.

The depression to be covered can be either a newly constructed structure such as a catchment, transporting duct, irrigation ditch, holding pond, lake, terrace, or such structure, or it can be a previously formed structure. A depression, for instance, could be an irrigation ditch that is in use without a lining or one in which the lining has deteriorated, for instance a concrete lined irrigation ditch that has cracked or spalled to the point where water is lost. An unlined irrigation ditch wastes a significant amount of water in that the quantity of water delivered at the end of the ditch can be as little as 50 percent of that entering the ditch. The earth surface, whether newly prepared or not, should be smoothed and prepared as discussed above. The surface to be covered by the cloth is such that the final covering is not damaged from contact with the surface.

After the surface of the depression is prepared as discussed above, the surface is covered with cloth. The cloth can be either woven or nonwoven. The cloth fibers can be many kinds suitable for the use in that they are preferably resistant to decomposition in contact with the earth, such as glass, polyester, polypropylene, nylon, rayon, or acrylic or blends of these fibers. The thickness of the cloth can be varied depending upon the strength and durability desired for the application. Generally, the thicker the cloth, the stronger it will be and the longer it will be able to function properly. Practical cloth thicknesses have varied from as little as 0.2 mm to as high 2 mm.

Generally, the size of a catchment or transporting duct or other appropriate earth surface will be of such a size that more than one piece of cloth will be required in the covering step. It is necessary to fasten the pieces of cloth together into a seam where they contact each other at their edges so that the finished structure will be impervious to liquid water. The pieces of cloth can be fastened together by suitable means such as sewing, bonding with adhesive, or fusion bonding if suitable thermoplastic fibers are being used in the cloth.

A preferred method of bonding pieces of cloth together at a seam makes use of a silicone elastomeric composition as the bonding material. The silicone elastomeric composition can be of any viscosity from a caulk material that does not flow but can be extruded from a container and spread out over the joint surface, to a freely flowing liquid silicone solvent dispersion or aqueous emulsion. The silicone elastomeric composition must bond to the cloth. The silicone elastomeric composition is of the type that cures under atmospheric conditions. Atmospheric conditions are those conditions of temperature and humidity that are present at the time of practicing the method.

Figure 6:
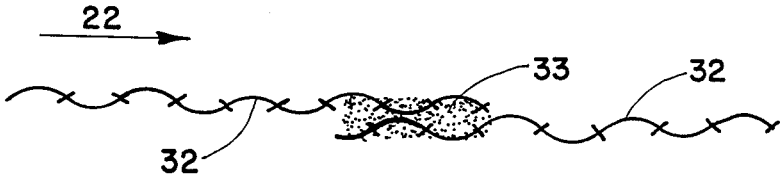
FIG. 6 is a cross section of a seam.

In a preferred method of bonding the pieces of cloth together, the pieces of cloth are overlapped as they are layed out to cover the appropriate earth surface, as illustrated in FIG. 6. It is desirable that the direction of water flow 22 be as shown. The amount of overlap depend somewhat upon the size of the pieces of cloth. For a cloth width of one metre, an overlap of 10 to 20 mm may be sufficient. For a cloth width of 5 meters, an overlap of 100 to 200 mm would be more appropriate. This overlap type of seam is easier to use since the spacing and size of the seam is not as critical as with a butt type of seam. The liquid silicone elastomeric compositions are easier to apply to the overlap seam than the caulk type. With the caulk type of bonding material, the caulk is placed between the overlapping pieces of cloth, then spread out and the pieces of cloth are pressed together, thus forcing the caulk into the facing cloth surfaces, bonding them together upon curing. The liquid silicone compositions can be applied by spraying, brushing, or rolling a coating onto the facing surfaces of the cloth, then placing the coated surfaces together to form the overlap. When the cloth being used is sufficiently thin and porous, it is possible to bond the pieces of cloth together by applying the liquid silicone composition to the upper surface of the upper piece of cloth at the seam and letting the liquid flow down through the seam and both pieces of cloth. It is necessary to apply sufficient composition to wet and impregnate both pieces of cloth, so that the resulting cured elastomer is present in sufficient quantity to bond the pieces of cloth together. The silicone elastomeric composition 33 is shown in FIG. 6 bonding the cloth 32 together. A preferred liquid silicone elastomeric composition is in the form of an aqueous emulsion since it is easily applied without the dangers of fire and toxicity commonly present when using solvent-containing compositions.

After the cloth is applied over the appropriate earth surface and the seams are bonded, the cloth is coated with liquid silicone elastomeric composition. It is necessary that the liquid silicone composition cure under atmospheric conditions when it is applied to the cloth. The viscosity of the liquid silicone composition is chosen so that the composition impregnates cloth and seals the spaces between the fibers to yield a surface impervious to liquid water. The liquid silicone composition can be a solvent dispersion or aqueous emulsion applied to the cloth by any suitable method such as brushing, rolling, or spraying, with spraying being the preferred method. A composition can be selected that is suitable for both bonding the pieces of cloth together and coating the cloth.

It is desirable that the liquid silicone elastomeric composition be in the form of an aqueous emulsion. An emulsion is desirable because there is no danger of hazardous fumes or fire during the application and curing of the coating. Clean-up of equipment is easier since only water is necessary.

An elastomeric silicone emulsion useful in this invention comprises (a) 100 parts by weight of an anionically stabilized, hydroxyl endblocked polyoiorganosiloxane, present as an oil-in-water emulsion, (b) from 1 to 150 parts by weight of colloidal silica, (c) from 0 to 200 parts by weight of filler other than colloidal silica, and (d) from 0.1 to 2.0 parts by weight of alkyl tin salt, said silicone emulsion having a pH of 9 to 11.5. Such elastomeric silicone emulsions are commercially available.

Silicone elastomeric compositions such as these are disclosed in U.S. Pat. No. 4,221,688, issued Sept. 9, 1980, to Johnson, Saam, and Schmidt, which is hereby incorporated by reference to describe silicone elastomeric compositions in the form of aqueous emulsions which are useful in the present invention for coating on the cloth and as bonding agents for use in bonding the seams. Such silicone elastomeric compositions cure by removal of the water from the emulsion.

There are also available liquid silicone elastomeric compositions based upon solvent dispersions of silicone compositions that cure at room temperature upon exposure to the atmosphere. Such systems that cure upon exposure to the moisture in the air are described in U.S. Pat. Nos. 3,189,576, issued Jun. 15, 1965 to Sweet and 3,334,067, issued Aug. 1, 1967 to Weyenberg, both of which are hereby incorporated by reference to show the manufacture of silicone elastomeric compositions that cure at atmospheric conditions and which may be liquid in the form of solvent dispersions suitable for coating on cloth and as bonding agents as used in this invention.

The liquid elastomeric compositions preferred for use in this invention are the aqueous emulsions, due to their low toxicity, ease of use, and ease of clean-up.

Examples of combinations of cloth and elastomeric silicone emulsions that have been used successfully are herein described. As elastomeric silicone emulsion having a solids content of 40 percent by weight and a viscosity of 25 Pa·s at 23° C. was sprayed onto a nonwoven polypropylene cloth of about 1.0 mm thickness. The emulsion penetrated into the fabric and sealed it to give an impervious coating. An emulsion with a solids content of 67 percent by weight and a viscosity of 60 Pa·s at 23° C. has also been found suitable for use with this fabric. The thicker, higher solids emulsion does not penetrate into the fabric as far as does the thinner material. A spun bonded, nonwoven polyester fabric having a thickness of 0.2 mm works well with the 40% solids, 25 Pa·s viscosity emulsion disclosed above. The emulsion is liquid enough to flow down through the fabric to the underside, resulting in the cloth being completely encapsulated by the emulsion. If desired, the cloth can be coated with a first coat that penetrates the cloth, then subsequent coats would be applied to impregnate and seal the cloth, resulting in an impervious coating on the cloth. The minimum solids content of the emulsion is 25 percent by weight based on the total weight of the emulsion. The solids content is the percent of nonvolatile material remaining in a 2 gram sample of the emulsion that has been heated for 1 hour at 150° C. in an air circulating oven. The sample is heated in an aluminum foil dish 60 mm in diameter and 15 mm deep.

The hydroxyl endblocked polydiorganosiloxanes useful in the aqueous emulsions used in this invention are those which can be emulsified and which will impart elastomeric properties to the product obtained after the removal of water. The best physical properties are obtained when the weight average molecular weight of the polymer is above 50,000. The preferred molecular weights are in the range of 200,000 to 700,000. The most preferred hydroxylated polydiorganosiloxanes are those prepared by the method of anionic emulsion polymerization described by Findley et al. in U.S. Pat. No. 3,294,725, issued Dec. 27, 1966, which is hereby incorporated by reference to show the methods of polymerization and to show the hydroxyl endblocked polydiorganosiloxane in emulsion. The anionic surfactants used are preferably the salt of the surface active sulfonic acids used in the emulsion polymerization to form the hydroxyl endblocked polydiorganosiloxanes as shown in U.S. Pat. No. 3,294,725 cited above which is hereby incorporated by reference to show the surface active sulfonic acids and salts thereof.

Colloidal silica is a required ingredient in the preferred emulsion. The silicone emulsion does not yield a cured film upon drying if the colloidal silica is not present in the composition. Any of the finely divided colloidal silicas that are capable of being dispersed in the silicone emulsion can be used. A preferred form of colloidal silica is available as colloidal silica dispersions in water.

An alkyl tin salt, preferably a dialkyltindicarboxylate, is used to reduce the storage time between the preparation of the silicone emulsion and the time an elastomeric product can be obtained from the silicone emulsion by removal of the water under ambient conditions to an acceptable range of one to three days. Dialkyl tin salts can be used in amounts of from 0.1 to 2.0 parts by weight for each 100 parts by weight of the hydroxyl endblocked polydiorganosiloxane, preferably about 0.1 to 1.0 parts by weight. Dialkyltincarboxylates which are preferred include dibutyltindiacetate, dibutyltindilaurate, and dioctyltindilaurate.

Another useful ingredient for addition to the silicone emulsion is a filler other than colloidal silica. Such fillers can be added to provide pigmentation which can be used, for example, as a colorant or as an ultraviolet light screening agent. Other fillers can be used as extending fillers which can be used to reduce the cost per unit of the elastomeric product. Examples of some other fillers other than colloidal silica include carbon blacks, titanium dioxide, clays, aluminum oxide, quartz, calcium carbonate, zinc oxide, mica, and various colorant pigments.

The preferred method of preparing the elastomeric silicone emulsion is to emulsify a hydroxyl endblocked polydiorganosiloxane using an anionic surfactant, add the colloidal silica, and then adjust the pH within the range of 10.5 to 11.5 inclusive. The preferred method of adjusting the pH has been found to be with a basic compound such as an organic amine, an alkali metal hydroxide, or a combination thereof. The preferred organic amine is diethylamine. The preferred alkali metal hydroxide is sodium hydroxide. After adjustment of the pH, the alkyl tin salt is added.

Further particulars on the preferred elastomeric emulsion used in the method of this invention are found in U.S. Pat. No. 4,221,688, issued Sept. 9, 1980, to Johnson, Saam, and Schmidt which is hereby incorporated by reference to further show the methods of manufacture.

In order for the coated cloth that lines the appropriate earth surface to function properly, the coated cloth must be stabilized by being secured to the depression surface at the unseamed edges at the outer perimeter of the coated cloth. Several suitable means are useful, depending upon the nature of the depression surface. For example, if the area is composed of compacted impervious soil or rock, the edge of the membrane can be bonded to the underlying surface with a suitable adhesive. The preferred adhesive is a silicone elastomeric composition such as those described above for bonding the coated cloth at the seams. The purpose of bonding the coated cloth to the surface is to prevent water from running under the coated cloth causing it to move about relative to the surface it is laying on.

Where it is necessary to construct a dike, the dike would ordinarily be constructed of soil or earth, at least on the outer surface. Since such a construction is not impervious to water, it is necessary to use methods other than bonding to secure the coated cloth to the surface.

Figure 7:
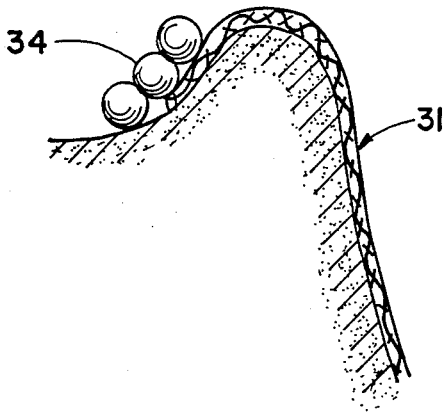
FIGS. 7, 8, 9, and 10 are various means of stabilizing the edge of coated cloth.
Figure 8:
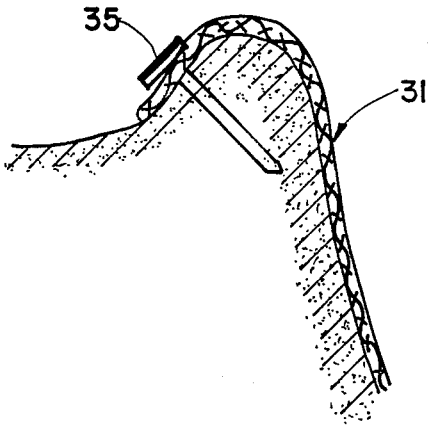
Figure 9:
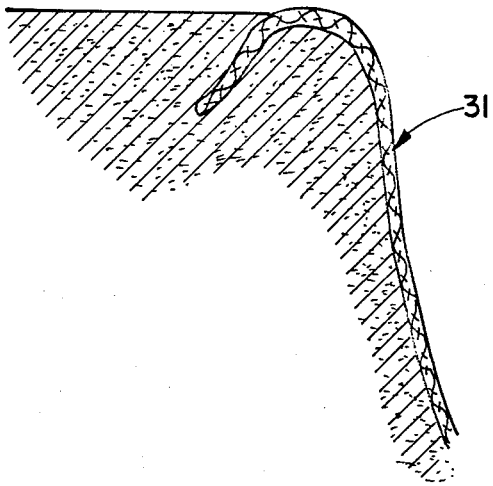
Figure 10:
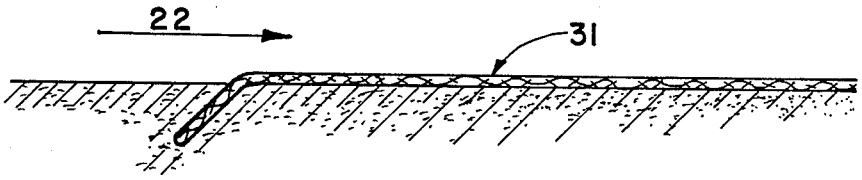

The simplest method of stabilizing the coated cloth edge to a dike is illustrated in FIG. 3. The coated cloth 31 is layed over the dike 23 so that the edge of the coated cloth is located on the back side of the dike. The edge of the coated cloth is then buried under soil placed on the back side of the dike. FIG. 7 illustrates the edge of the coated cloth 31 ballasted with rocks 34 to secure the coated cloth. FIG. 8 illustrates the coated cloth 31 secured to the back side of a dike 23 by means of a peg with a large upper head 35. Other mechanical fasteners such as a staple-shaped rod are also suitable. FIG 9 illustrates the stabilizing of the cloth edge by burying it in a small side ditch next to the main transporting duct. FIG 10 illustrates a method of stabilizing the edge of coated cloth 31 where it is exposed to water flow 22, as at the upper edge of a catchment that is constructed to gather water flowing down a hillside as shown in FIG. 1. The upper edge of coated cloth used to line an irrigation ditch could be buried in such a manner to stabilize the cloth. The water flowing into the irrigation ditch would be prevented from getting underneath the cloth and displacing it. The cloth that is buried can be either coated or uncoated. The cloth edge can be buried either before the remainder of the cloth is coated or the entire cloth can be coated and then the edge buried. If the entire cloth is coated and then the edge is buried, the coated cloth protects the upper edge of the construction from the effects of water coming through the uncoated cloth and possibly displacing the edge through erosion.

The cloth used in this invention is flexible and follows the contour of the depression when it is layed in place. After coating with the liquid silicone elastomeric composition, the coated cloth is still flexible enough to allow stabilization of the cloth at the unseamed edges around the perimeter of the cloth.

The method of this invention yields a covered depression lined with a cloth coated with a silicone elastomer.

Many previous methods used to form covered areas such as water harvesting structures are more complicated to construct and more expensive. Methods such as lining with concrete, both with and without metal reinforcement, are expensive due to the cost of the concrete and reinforcement and the amount of labor and equipment necessary to put the concrete into place and hold it there until it cures. Such a lining is subject to cracking from temperature changes since it has no elasticity. Much the same is true of asphalt but in addition, heavy equipment is required to heat the asphalt and to spread it and compact it in place. Asphalt is subject to cracking from temperature changes, and to weathering from the sun and from the oxygen in the air. Methods using asphalt emulsion suffer due to the inability of the asphalt to withstand temperature changes and weathering effects in the relatively thin coatings used.

The method of making a covered area, such as a catchment and transporting duct for water harvesting, of this invention is particularly useful for agricultural areas that are difficult to get to. If necessary, the required shaping of a catchment and transporting duct can be done with hand tools. The lining of the area with the cloth, bonding the seams, coating the cloth, and securing the edges of the coated cloth can all be done without expensive, heavy equipment. The coated cloth is resistant to weathering so that the structure will have a long, useful life. A particular use is as a water harvesting structure for use for animals in mountainous terrain.

The covered area is unique because of the nature of the coated cloth. The coated cloth can be easily produced on site. When the preferred elastomeric silicone emulsion is used to prepare the coated cloth, no dangerous or toxic substances are given off during the coating and drying steps. The coated cloth is flexible and elastic at temperatures ranging from below −30° C. to above 70° C. so that the coated cloth does not crack due to temperature changes. The coated cloth is particularly useful in this method because it is resistant to the effects of temperatures, sunlight, oxidation from the air and other causes of outdoor weathering. The coated cloth prepared using the preferred elastomeric silicone emulsion retards the growth of vegetation under it, thus aiding in obtaining a long, useful life since plants do not seem to puncture the impervious coating. The coated cloth is not easily pierced by rodents, worms, ants, etc., nor does there appear to be any tendency for such wildlife to attempt to eat the covering as has happened with some types of organic plastics such as have been used for underground pipes or electrical wiring insulation. The covering is resistant to mechanical damage because of its tough, elastic, flexible character. Such potentially damaging events as falling rock, flash floods, and being walked on by animals have been experienced by experimental coverings without damage. The covering can also be colored to light or dark colors as desired by pigmenting the liquid silicone elastomeric coating. A catchment, for instance, can be colored to blend into the terrain on a mountainside so that it is inconspicuous when it is located in an area such as a wilderness area viewable from a mountain road. A holding pond could be black so that the water would be heated by any sunlight shining onto the pond. The construction of the covered earth surface according to the method of this invention can be accomplished without highly skilled and expensive labor.

The following examples are presented for purposes of illustrating the invention and should not be construed as limiting the scope of the invention which is properly delineated in the claims.

EXAMPLE 1

Figure 4:
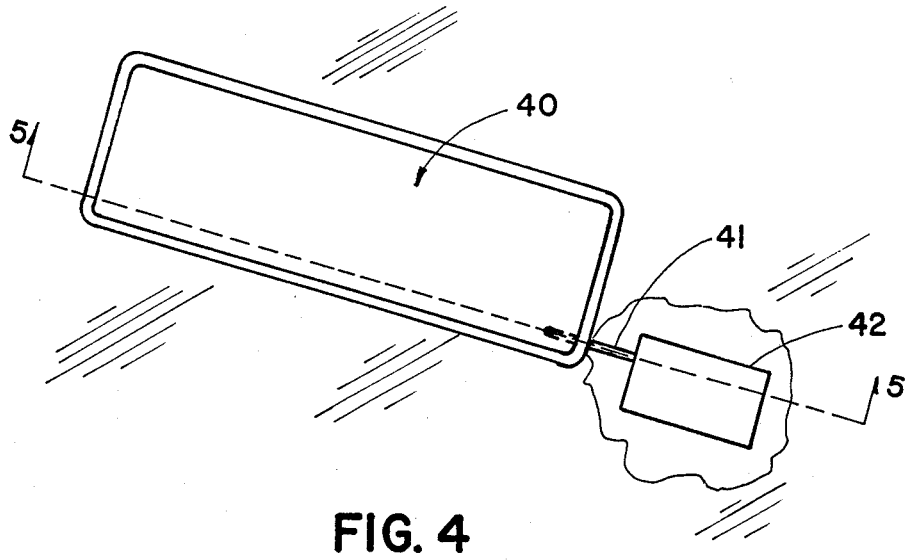
FIG. 4 is a top view of a catchment area 40 designed to collect water and direct it to a pipe 41 leading to a buried storage tank 42.
Figure 5:
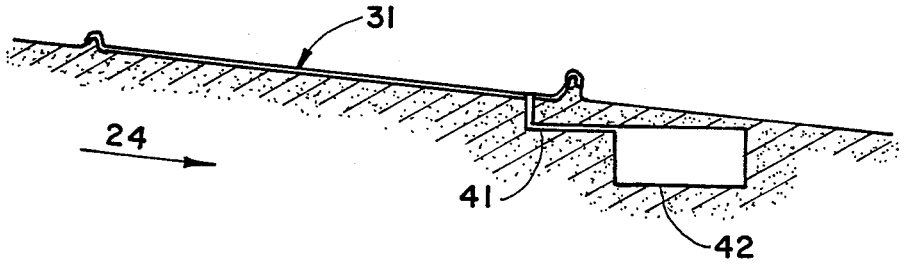
FIG 5 is a cross section of the construction shown in FIG. 4 along line 5—5.

A catchment area of about 640 $m^2$ was prepared with a bulldozer to smooth and grade the area. The catchment was located at an elevation of about 2000 meters in an area of shallow, rocky soil. A steel storage tank was buried in the earth below the catchment area and a pipe was layed connecting the lower end of the catchment area to the buried tank. After the area was graded, the soil was treated with a herbicide to inhibit the further growth of vegetation under the lining to be installed. The outer edges of the catchment area were built up into dikes using the soil from the area. The dike at the upper edge of the area was about 0.3 meter in height while the dike at the lower edge was about 1 meter in height. FIG. 4 is an illustration of this construction. The catchment 40 is located on a slope so that water flows to the corner containing the connecting pipe 41 which leads to storage tank 42 which is buried in the earth. FIG. 5 is a cross section view of the construction along line 5—5 in FIG. 4 showing the coated cloth 31 in place lining the catchment.

Pieces of a nonwoven polyester cloth about 4.2 meters wide and of about 1 mm thickness were then layed out over the catchment and dike area. The cloth pieces were overlapped at the seams about 20 to 30 cm. The cloth extended over the dike to the bottom of the dike on the outer side. Logs were placed on the edges of the cloth at the perimeter on the back side of the dikes to hold it in place.

Two methods were used to bond the pieces of cloth together at the seams. About 8 meters of seam length were bonded using a hot air gun. The polyester fibers were heated to their softening point at the seam, then the two layers were pressed together with a roller to cause the fibers to fuse together, then they were cooled The remainder of the seams were bonded together by spraying the adjoining surfaces of the seams with an aqueous silicone elastomeric emulsion, described below, until the surfaces were saturated, placing the saturated surfaces together, and then pressing them together by walking on the seams. The seams were allowed to dry overnight to cure.

An anionically stabilized emulsion polymerized polydimethylsiloxane was prepared containing about 58 percent by weight of hydroxyl endblocked polymethylsiloxane having a weight average molecular weight of about 325,000. This aqueous emulsion was anionically stabilized with the sodium salt of dodecylbenzene sulfonic acid present in an amount of about 1 percent based on the weight of the emulsion.

A silicone emulsion was prepared by first mixing. 6.3 parts by weight of a sodium stabilized colloidal silica dispersion having 15 percent by weight silica with 0.7 part by weight of diethylamine. Then 63.6 parts by weight of the above emulsion of polydimethylsiloxane was mixed in. Next 0.2 part of silicone antifoam, 0.2 part of propylene-glycol, and 0.4 part of a 50 percent by weight dioctyltindilaurate emulsion were mixed in until uniform. Then 27.7 parts by weight of kaolin clay filler was mixed in. The emulsion had a viscosity of 60 Pa·s at 25° C. and a solids content of 67 percent by weight. The pH of the emulsion was 11.5.

The lining of cloth was then coated by spraying the above described silicone emulsion over the cloth at a rate of about 0.001 $m^3/m^2$. The emulsion dried in about 4 hours, then a second coat was applied, spraying at right angles to the first, at a rate of about 0.0002 $m^3/m^2$.

The second coat was dry and cured after 4 hours at atmospheric conditions.

The coated cloth was cut and fitted to the entrance of the pipe leading to the storage tank, then bonded with the silicone emulsion.

The catchment has operated successfully, gathering rainfall and directing it to the pipe leading to the storage tank. The catchment has withstood the effects of wide temperature differentials and high winds. It is expected to have a long useful life.

EXAMPLE 2

A transporting duct was manufactured by first cleaning a ditch of about 1 meter width of all vegetation. Pieces of nonwoven cloth of polyester fibers about 1.5 meters wide and of varying lengths, depending upon the terrain, were unrolled to line the ditch, the edges of the cloth extending over the edges of the ditch. The adjoining pieces of cloth were overlapped about 20 to 30 cm to form seams perpendicular to the ditch with the upstream piece being over the lower piece. The seams were bonded by spraying the facing surfaces with an aqueous silicone elastomeric emulsion until the surfaces were saturated, then placing the surfaces together and pressing them into place. The seams were allowed to dry producing a bonded seam. The edges of the cloth extending over the edges of the ditch were held in place by covering them with earth.

The cloth lining the ditch was then coated by spraying with the silicone emulsion of Example 1 at a rate of about 0.001 $m^3/m^2$. The emulsion impregnated the surface of the 1 mm thick cloth. When dried, the coated cloth formed a lining that was impervious to liquid water.

When water was introduced into the ditch, it was transported without the seepage loss that had been characteristic of the unlined ditch. The water flowed through the ditch at a higher rate after the ditch was lined.

That which is claimed is:

1. A method of constructing a means suitable for directing or holding water comprising (A) laying cloth on an earth surface of a depression suitable to direct, transport or hold water, (B) fastening the cloth at seams, then (C) coating the cloth with liquid silicone elastomeric composition curable at atmospheric conditions, (D) allowing the composition to cure at atmospheric conditions to yield a covering impervious to liquid water, and (E) stabilizing the cloth at unseamed edges.

2. The method of claim 1 in which the depression in (A) is a catchment suitable for collecting water.

3. The method of claim 1 in which the depression in (A) is a transporting duct suitable for transporting water to a predetermined destination.

4. The method of claim 1 in which the depression in (A) is a water holding area.

5. The method of claim 2 in which the depression in (A) comprises the catchment and a transporting duct serving as an outlet for the catchment.

6. The method of claim 5 in which the depression in (A) comprises the catchment, transporting duct, and a water holding area which serves as a reservoir for water from the transporting duct.

7. The method of claim 2 in which the depression in (A) comprises the catchment and a water holding area which serves as a reservoir for water from the catchment.

8. The method of claim 3 in which the depression in (A) comprises the transporting duct and a water holding area which serves as a reservoir for water from the transporting duct.

9. The method of claim 1 in which the liquid silicone elastomeric composition comprises a hydrocarbon solvent dispersion of a silicone elastomeric composition.

10. The method of claim 1 in which the liquid silicone elastomeric composition comprises an aqueous silicone emulsion.

11. The method of claim 10 in which the aqueous silicone emulsion comprises (a) 100 parts by weight of an anionically stabilized, hydroxyl endblocked polydiorganosiloxane present as an oil-in-water emulsion, (b) from 1 to 150 parts by weight of colloidal silica, (c) from 0 to 200 parts by weight of filler other than colloidal silica, and (d) from 0.1 to 2.0 parts by weight of alkyl tin salt, said emulsion having a pH of 9 to 11.5.

12. The method of claim 11 in which the polydiorganosiloxane has an average molecular weight in the range of 200,000 to 700,000; the colloidal silica is present as a sodium stabilized colloidal silica dispersion in an amount of from 15 to 50 parts by weight; there is present a filler other than colloidal silica; the alkyl tin salt is a diorganotindicarboxylate; there is also present an organic amine composed of carbon, hydrogen, and nitrogen atoms, or carbon, hydrogen, nitrogen, and oxygen atoms, said organic amine being soluble in the amount of water present in the emulsion, and the solids content of the emulsion is greater than 25 percent by weight based on the total weight of the emulsion.

13. The method of claim 10 in which the cloth is a woven or nonwoven cloth comprising weather resistant fibers selected from the group consisting of glass, polyester, polypropylene, nylon, rayon, or acrylate, or a mixture of these fibers.

14. The method of claim 13 in which the fibers are polypropylene.

15. The method of claim 13 in which the fibers are polyester.

16. The method of claim 1 in which the cloth comprises at least two pieces which are fastened at the seams by sewing.

17. The method of claim 1 in which the cloth comprises at least two pieces which are fastened at the seams by heat fusion.

18. The method of claim 1 in which the cloth comprises at least two pieces which are fastened at the seams by adhesive bonding.

19. The method of claim 18 in which the adhesive bonding is by means of a silicone elastomeric composition.

20. The method of claim 19 in which the silicone elastomeric composition is an aqueous emulsion.

21. The method of claim 20 in which the aqueous emulsion comprises (a) 100 parts by weight of an anionically stabilized hydroxyl endblocked polydiorganosiloxane present as an oil-in-water emulsion;

(b) from 1 to 150 parts by weight of colloidal silica, (c) from 0 to 200 parts by weight of filler other than colloidal silica, and (d) from 0.1 to 2.0 parts by weight of alkyl tin salt, said emulsion having a pH of 9 to 11.5.

22. The method of claim 11 in which the cloth comprises at least two pieces which are fastened at the seams by adhesive bonding by means of an aqueous silicone elastomeric emulsion.

23. The method of claim 1 in which the cloth is coated by brushing.

24. The method of claim 1 in whcih the cloth is coated by spraying.

25. The method of claim 1 in which the stabilizing consists of burying beneath the earth surface.

26. The method of claim 2 in which the stabilizing comprises bonding to the underlying earth surface.

27. The method of claim 6 in which the stabilizing comprises mechanical fastening.

28. The method of claim 3 in which the stabilizing comprises burying beneath the earth surface.

29. The method of claim 2, 3, 4, 5, 6, 7, or 8 in which the cloth comprises at least two pieces of nonwoven fabric which are fastened at the seams by adhesive bonding and coated by spraying with an aqueous silicone emulsion.

30. The method of claim 29 in which the nonwoven fabric is layed upon the earth surface in an overlapping fashion at adjoining edges; the adjoining edges being adhesively bonded with a silicone elastomeric composition to form seams; the cloth, fastened by seams, being coated with an aqueous silicone emulsion comprising (a) 100 parts by weight of an anionically stabilized, hydroxyl endblocked polydiorganosiloxane present as an oil-in-water emulsion, (b) from 1 to 150 parts by weight of colloidal silica, (c) from 0 to 200 parts by weight of filler other than colloidal silica, and (d) from 0.1 to 2.0 parts by weight of alkyl tin salt, said emulsion having a pH of 9 to 11.5.

31. The method of claim 30 in which the silicone elastomeric composition used to adhesively bond the adjoining edges to form seams is an aqueous silicone emulsion, and the unseamed edges are stabilized by burying beneath the earth surface.

32. The method of claim 31 in which the aqueous silicone emulsion used to adhesively bond the adjoining edges is the aqueous silicone emulsion used to coat the bonded cloth.

33. A structure produced by the method of constructing a means suitable for directing of holding water comprising (A) laying cloth on an earth surface of a depression suitable to direct, transport, or hold water, (B) fastening the cloth at the seams, then (C) coating the cloth with liquid silicone elastomeric composition curable at atmospheric conditions, (D) allowing the composition to cure at atmospheric conditions to yield a covering impervious to liquid water, and (E) stabilizing the cloth at unseamed edges.

34. The structure of claim 33 in which the depression in (A) comprises a catchment and a water holding area which serves as a reservoir for water from the catchment.

35. The structure of claim 33 in which the cloth comprises at least two pieces of non woven fabric which are layed upon the earth surface in an overlapping fashion at adjoining edges; the adjoining edges being adhesively born from seams with an aqueous silicone emulsion comprising (a) 100 parts by weight of an anionically stabilized, hydroxyl endblocked polydiorganosiloxane present as an oil-in-water emulsion, (b) from 1 to 150 parts by weight of colloidal silica, (c) from 0 to 200 parts by weight of filler other than colloidal silica, and (d) from 0.1 to 2.0 parts by weight of alkyl tin salt, said emulsion having a pH of 9 to 11.5, the cloth, fastened by seams, being coated with the aqueous silicone emulsion used to adhesively bond to seams, and the unseamed edges being stabilized by burying beneath the earth surface.

* * * * *